US008369559B2

(12) United States Patent
Liang et al.

(10) Patent No.: US 8,369,559 B2
(45) Date of Patent: Feb. 5, 2013

(54) SPEAKER ASSEMBLY

(75) Inventors: Ying-Ye Liang, Shanghai (CN); Shi-Jun Yang, Shanghai (CN); Ping Li, Shanghai (CN); Xiao-Yong Cui, Shanghai (CN)

(73) Assignees: Ambit Microsystems (Shanghai) Ltd., Shanghai (CN); Hon Hai Precision Industry Co., Ltd., New Taipei (TW)

( * ) Notice: Subject to any disclaimer, the term of this patent is extended or adjusted under 35 U.S.C. 154(b) by 306 days.

(21) Appl. No.: 12/826,587

(22) Filed: Jun. 29, 2010

(65) Prior Publication Data

US 2011/0150263 A1 Jun. 23, 2011

(30) Foreign Application Priority Data

Dec. 21, 2009 (CN) ..... 2009 2 0317952 U

(51) Int. Cl.
*H04R 1/02* (2006.01)

(52) U.S. Cl. ..... 381/386

(58) Field of Classification Search ..... 381/386
See application file for complete search history.

(56) References Cited

U.S. PATENT DOCUMENTS

| | | | | |
|---|---|---|---|---|
| 5,182,872 | A * | 2/1993 | Lee et al. | 40/717 |
| 5,844,999 | A * | 12/1998 | Kameda et al. | 381/386 |
| 5,912,967 | A * | 6/1999 | Gaffney et al. | 379/420.02 |
| 8,073,172 | B2 * | 12/2011 | Sip | 381/323 |
| 2010/0215203 | A1 * | 8/2010 | Sip | 381/386 |
| 2011/0150263 | A1 * | 6/2011 | Liang et al. | 381/386 |
| 2012/0099749 | A1 * | 4/2012 | Rubin et al. | 381/332 |

* cited by examiner

*Primary Examiner* — Jeffrey Donels
(74) *Attorney, Agent, or Firm* — Altis Law Group, Inc.

(57) ABSTRACT

A speaker assembly includes a base including two receiving holes, a cover mounted on a first surface the base, a speaker, a flexible printed circuit (FPC) attached to a second surface the base opposite to the first surface, and two springs received in the receiving holes. The cover includes a receiving space to receive the speaker. The speaker includes two first pads. The FPC includes two second pads. The springs electrically connect the first pads to the second pads.

6 Claims, 4 Drawing Sheets

SPEAKER ASSEMBLY

BACKGROUND

1. Technical Field

The present disclosure generally relates to communication devices, and more particularly to a speaker assembly of a communication device.

2. Description of Related Art

Communication devices, for example mobile phones, often utilize speakers to transmit and receive voice signals. Frequently, a communication device includes connectors to connect a speaker to a main circuit board mounted in the communication device. However, production cost of the communication device is increased by the cost requirement of the connectors, and efforts toward miniaturization are compromised.

Therefore, a need exists in the industry to overcome the described limitations.

DETAILED DESCRIPTION

Figure 1:
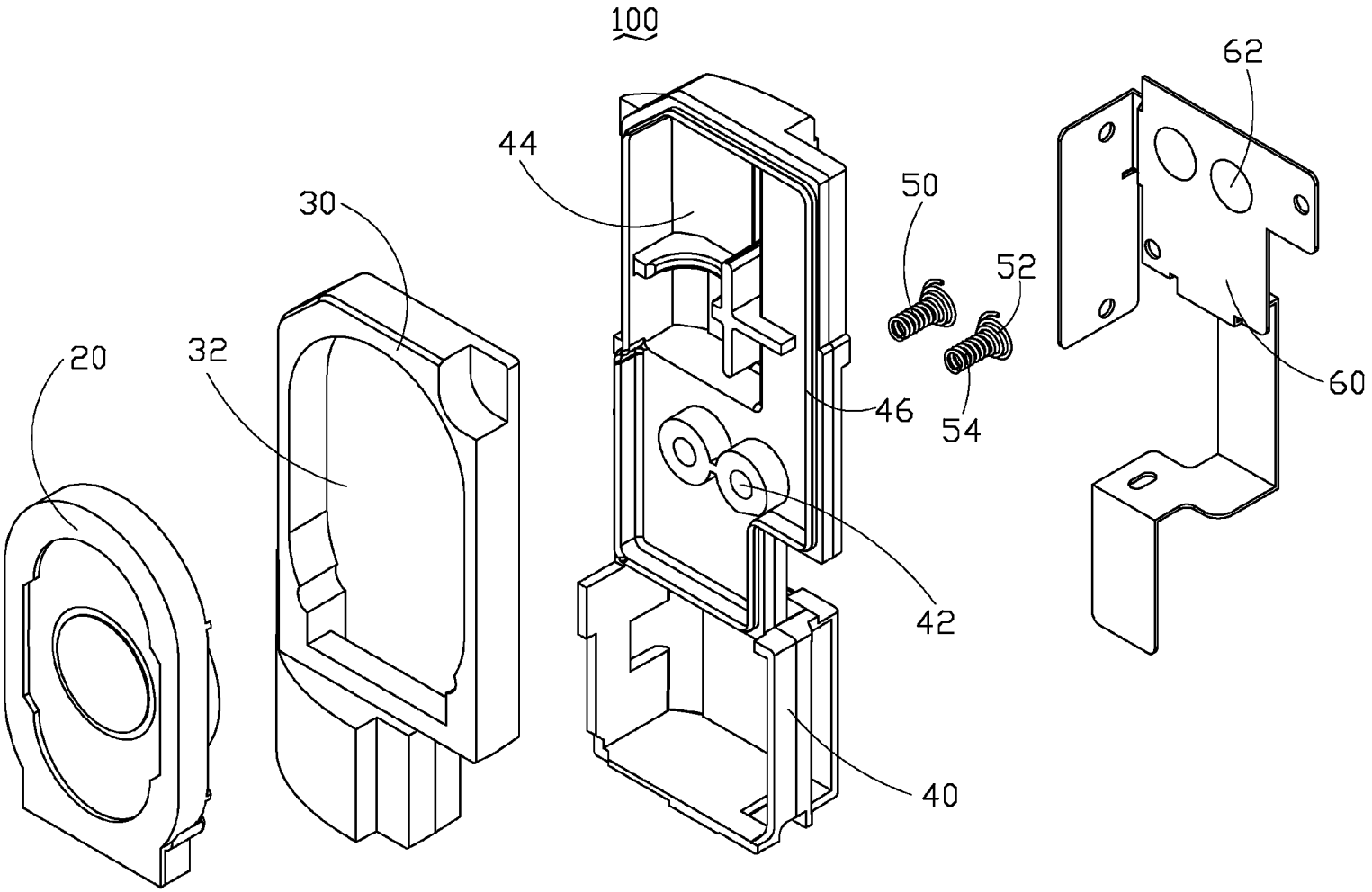
FIG. 1 is an exploded, isometric view of a speaker assembly of an exemplary embodiment of the disclosure.

Referring to FIG. 1, a speaker assembly 100 of a communication device is disclosed. The speaker assembly 100 includes a speaker 20, a cover 30, a base 40, a pair of springs 50, and a flexible printed circuit (FPC) 60. The communication device in this embodiment is a mobile phone, but the disclosure is not limited thereto.

Figure 2:
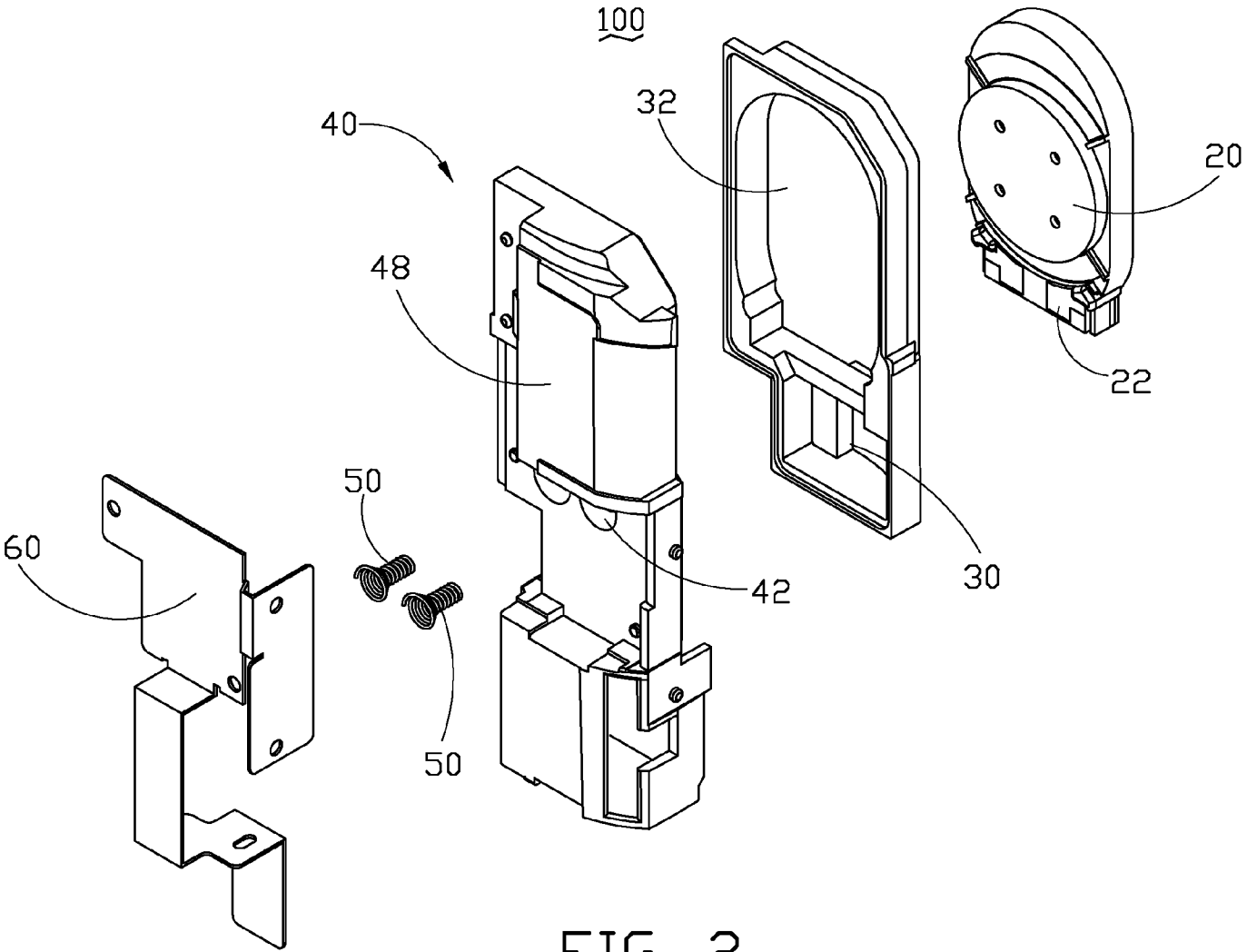
FIG. 2 is similar to FIG. 1, viewed from another aspect.

Referring also to FIG. 2, the speaker 20 includes a pair of first pads 22 located in a bottom portion of the speaker 20.

The cover 30 is mounted on a first surface 46 of the base 40, and defines a receiving space 32 to receive the speaker 20.

Figure 4:
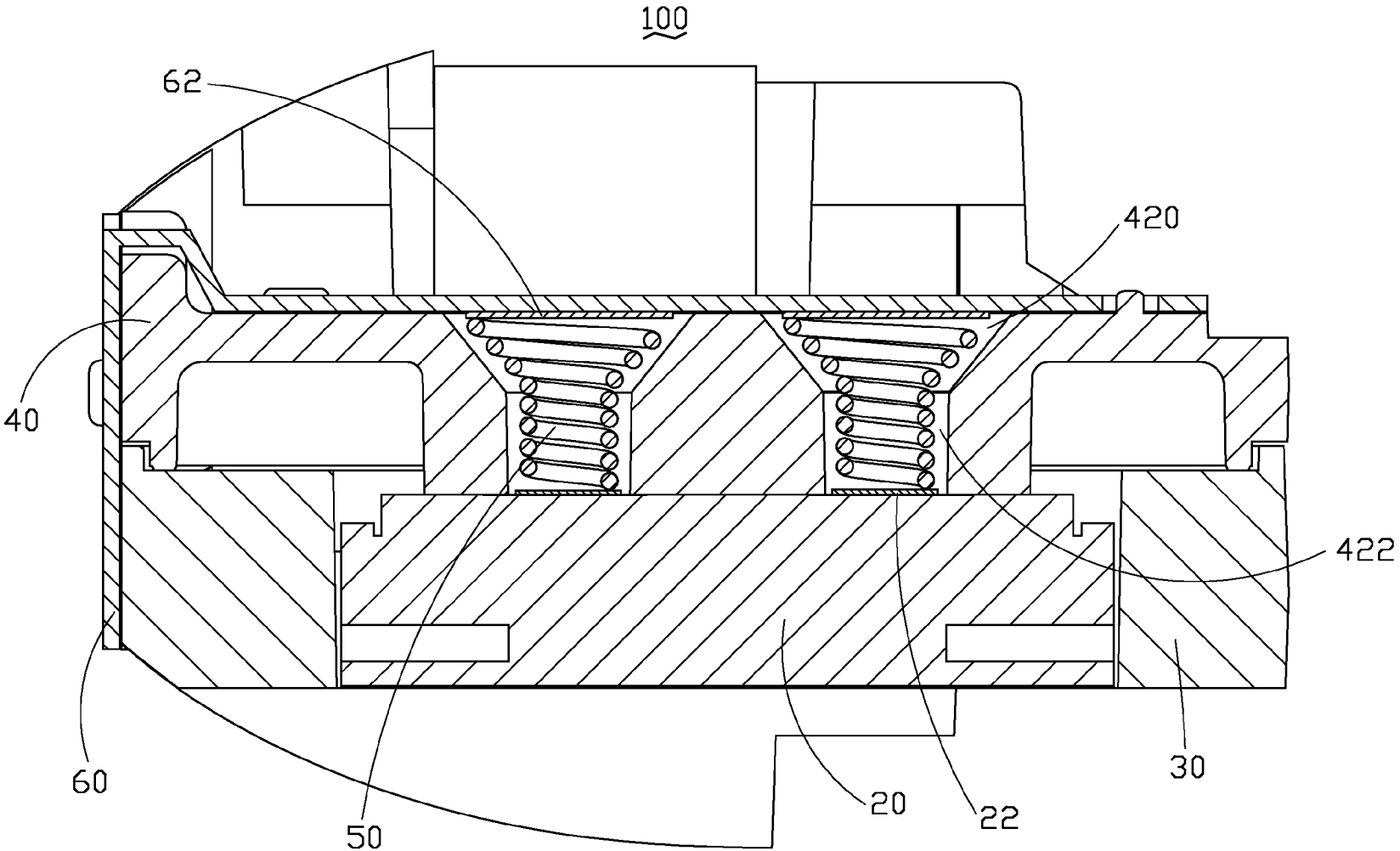
FIG. 4 is a cross-section along line IV-IV of FIG. 3.

The base 40 includes a pair of ladder-shaped receiving holes 42. Referring also to FIG. 4, each of the receiving holes 42 includes a tapered first hole 420 and a second hole 422 in communication with the first hole 420. A least diameter of the first hole 420 is substantially equal to a diameter of the second hole 422.

The base 40 further includes a cavity 44 corresponding to the receiving space 32. After assembly, the cavity 44 acts as a cavity of the speaker 20.

The springs 50 are received in the receiving holes 42 to electrical connect the speaker 20 to the FPC 60. Each of the springs 50 includes a tapered spring 52 received in the first hole 420 and a coil spring 54 received in the second hole 422. A least diameter of the tapered spring 52 is substantially equal to a diameter of the coil spring 54.

The FPC 60 is electrical connected to a main circuit board (not shown) and mounted on a second surface 48 of the base 30 opposite to the first surface 46. The FPC 60 includes a pair of second pads 62 electrically connected to the first pads 22 by the springs 50.

Figure 3:
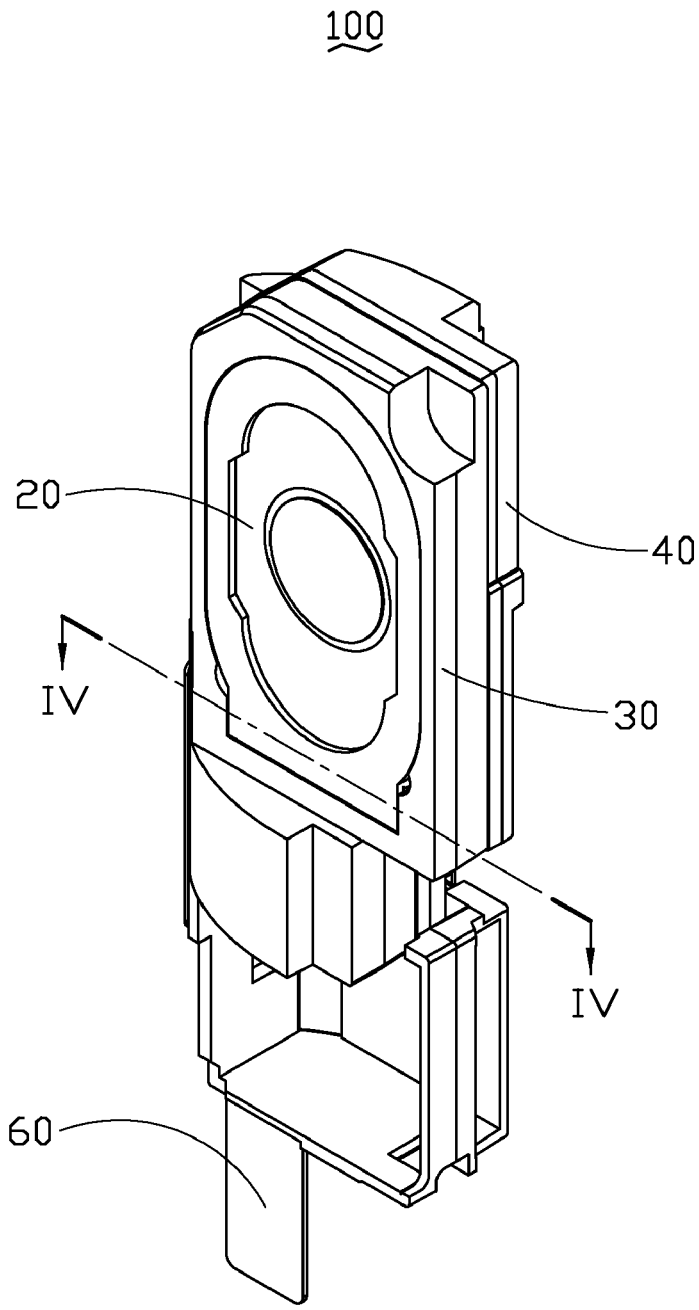
FIG. 3 is an assembled view of FIG. 1.

Referring to FIGS. 3 and 4, in assembly, the speaker 20 is received in the receiving space 32 of the cover 30. The cover 30 is mounted on the first surface 46 of the base 40. The springs 50 are received in the receiving holes 42. The FPC 60 is attached to the second surface 48 of the base 40. Thus, the speaker 20, the cover 30, the base 40, the springs 50, and the FPC 60 are assembled into the speaker assembly 100. In the assembled state, the FPC 60 electrically connects the speaker 20 to the main circuit board, and seals the receiving holes 42 of the base 40.

Because the speaker 20 is electrically connected to the main circuit board by the FPC 60 and the springs 50, the speaker assembly 100 requires no additional structure or elements to electrically connect the speaker 20 to the main circuit board, with the desired simplification of circuit design of the main circuit board and reduction of production cost of the speaker assembly 100 being achieved.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. A speaker assembly, comprising:

a base comprising a pair of receiving holes;

a cover mounted on a first surface of the base and comprising a receiving space;

a speaker received in the receiving space and comprising a pair of first pads;

a flexible printed circuit (FPC) attached to a second surface of the base opposite to the first surface, the FPC comprising a pair of second pads; and a pair of springs received in the receiving holes to electrically connected the first pads to the second pads.

2. The speaker assembly as recited in claim 1, wherein each of the receiving holes is ladder-shaped, and comprises a tapered first hole and a second hole in communication with the first hole.

3. The speaker assembly as recited in claim 2, wherein a least diameter of the first hole is equal to a diameter of the second hole.

4. The speaker assembly as recited in claim 2, wherein each of the springs comprises a tapered spring received in the first hole and a coil spring received in the second hole.

5. The speaker assembly as recited in claim 4, wherein a least diameter of the taper spring is equal to a diameter of the coil spring.

6. The speaker assembly as recited in claim 1, wherein the base further comprises a cavity corresponding to the receiving space.

* * * * *